United States Patent [19]

Good

[11] 3,959,927

[45] June 1, 1976

[54] SEALING ASSEMBLY

[75] Inventor: Samuel William Good, Lancaster

[73] Assignee: Zephyr Aluminum, Incorporated, Lancaster, Pa.

[22] Filed: Dec. 4, 1974

[21] Appl. No.: 529,292

[52] U.S. Cl. ..... 49/368; 49/483; 49/366

[51] Int. Cl.[2] ..... E06B 7/16

[58] Field of Search ..... 49/368, 483, 366, 313, 49/383, 384

[56] References Cited

UNITED STATES PATENTS

| | | | |
|---|---|---|---|
| 661,653 | 11/1900 | Youlten | 49/483 |
| 1,270,869 | 7/1918 | Relling | 49/483 |
| 2,797,958 | 7/1957 | Podolan | 49/483 |
| 3,077,644 | 2/1963 | Kesling | 49/366 |
| 3,150,422 | 9/1964 | Michaels | 49/368 |
| 3,487,581 | 1/1970 | Ellingson, Jr. | 49/366 |
| 3,590,531 | 7/1971 | Childs | 49/368 |
| 3,653,155 | 4/1972 | Brunyn, Jr. et al. | 49/368 |
| 3,660,940 | 5/1972 | Tavano | 49/366 |
| 3,827,183 | 8/1974 | Zimmerman et al. | 49/366 |

FOREIGN PATENTS OR APPLICATIONS

| | | | |
|---|---|---|---|
| 870,176 | 1/1953 | Germany | 49/368 |
| 1,342,662 | 9/1963 | France | 49/483 |
| 46,348 | 8/1939 | Sweden | 49/383 |

*Primary Examiner*—Paul R. Gilliam
*Assistant Examiner*—V. Sakran
*Attorney, Agent, or Firm*—John C. Thompson

[57] ABSTRACT

A sealing assembly adapted to close the gap between the swinging edge of a door and an associated member. In one embodiment the sealing assembly includes first and second generally cylindrical elements having a plurality of spaced apart teeth which extend radially outwardly from the elements, and first and second mounting means to mount the elements for free rotational movement in such a manner that they are parallel with each other and the edges of the associated structure so that when the door is closed the teeth of the first and second elements will interengage with each other. In a second embodiment the first element again is a generally cylindrical element having a plurality of outwardly extending teeth, and the second element has a rack-like structure which is adapted to interengage the teeth of the first member, the rack-like structure being mounted on an adjacent surface in such a manner that the teeth of the rack-like structure and the teeth of the rotary element will interengage when the door is closed.

6 Claims, 4 Drawing Figures

SEALING ASSEMBLY

FIELD OF THE INVENTION

The present invention relates generally to sealing devices for closures, and more particularly, to a sealing assembly which includes a first subassembly adapted to be mounted on the swinging edge of a door and a second subassembly adapted to be mounted on either the swinging edge of an adjacent door or a doorjamb, the first and second subassemblies being mounted in such a manner that they will interengage with each other to seal the gap between the swinging edge of a door and an associated member when the door is closed. The present invention has particular utility when utilized with a pair of panic doors having adjacent swinging edges.

BACKGROUND OF THE INVENTION

It is generally well-known that it is easy to attain unauthorized entry through a pair of adjacent panic doors provided with crash bars. Thus, unauthorized entry can be achieved by inserting a wire hook through the gap between the meeting stiles, the wire hook then being maneuvered in such a manner as to engage the crash bar so it can be depressed. In order to prevent unauthorized entry padlock chains are often wound through the crash bars. While chaining prevents the doors from being opened, it is a serious violation of fire and other safety codes. Not only are the building's occupants in danger in the case of fire, but the owner or manager of the building can be fined and in some cases even jailed for the employment of such chains. It is also possible to make the paired panic doors relatively secure by providing a removable plate which is secured to the swinging stile of one door and which extends across the gap to lie against the swinging stile of the other door. The use of such plates generally do not meet with the fire and safety codes as it is necessary to open one door before the other door can be opened. While banks of single panic doors are relatively secure and meet various fire and safety codes, they seriously impede traffic flow and also eliminate the possibility of moving large objects through the entrance.

Various sealing devices are known in the prior art and U.S. Pat. Nos. 3,590,531 and 3,653,155 are considered to be representative of the prior art. Both of these Patents disclose relatively complex structures which include at least one pivoted sealing member. Another form of security device is known as the Kawneer "Panic Guard" Entrance, this employing a retracting bar that closes the gap between adjacent panic doors for the full height of the entrance. This structure has the disadvantage in that special purpose stiles are required, and is also relatively complex. Alternatively, a security bolt assembly may be provided such as the type shown in U.S. Pat. No. 3,656,788. Obviously, when such a bolt is closed the doors are generally not in compliance with fire and safety codes.

OBJECTS AND SUMMARY OF THE INVENTION

It is the principal object of the present invention to provide a sealing assembly which can be disposed between the swinging edge or stile of a door and an associated member to effectively seal the edge when the door is in its closed position and also to act as a deterrent to unauthorized entry.

More particularly, it is an object of the present invention to provide a sealing assembly which includes a first element having a plurality of radially outwardly extending teeth, the first element being mounted for free rotational movement upon one edge of a door, the assembly also including a second element provided with outwardly extending teeth which are adapted to interengage with the teeth of the first element when the door is in a closed position.

These and other objects of the invention are attained by providing a sealing assembly which includes a first generally cylindrical element having a plurality of spaced apart teeth which extend radially outwardly from the axis of the first element, first mounting means adapted to mount the first element for free rotational movement about its axis with the axis extending parallel to the edge of the door, a second element having a plurality of spaced apart teeth, and means to mount the second element on an associated member. In one embodiment of this invention the second element includes a rack-like structure. In an alternative embodiment, the second element is substantially identical to the first element. Means are provided for adjustably mounting the first and second elements in such a manner that the teeth of the first and second elements will interengage each other throughout their length.

The objects set forth above and additional objects and advantages of this invention will be apparent to those skilled in the art after a consideration of the following detailed description, taking in conjunction with the accompanying drawings in which a preferred form of this invention is illustrated.

DESCRIPTION OF THE EMBODIMENT SHOWN IN FIGS. 1, 2 AND 3

Figure 1:
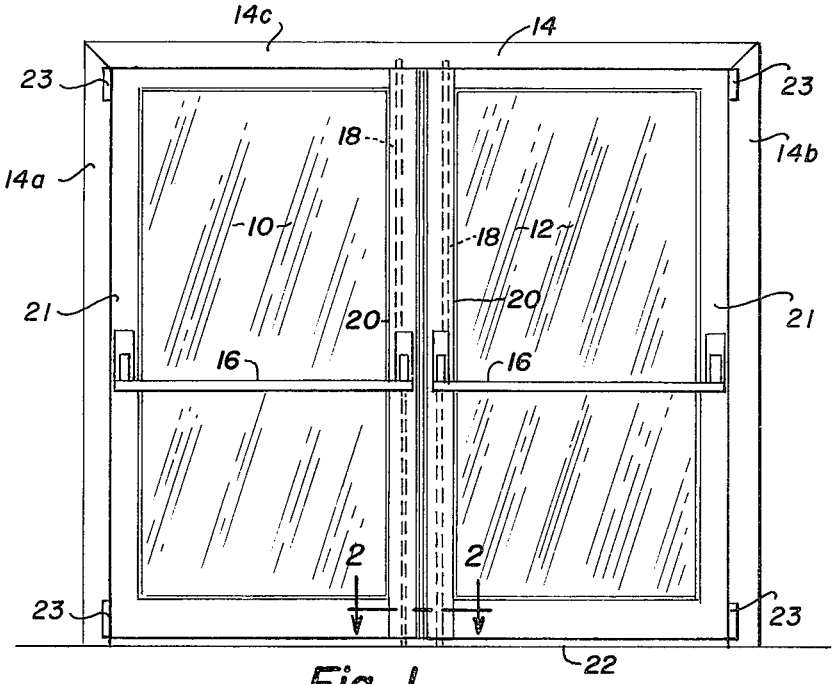
FIG. 1 is a side view of a pair of adjacent panic doors in which a first embodiment of this invention is incorporated, the doors having adjacent swinging stiles.

Referring first to FIG. 1, a pair of panic doors, 10 and 12, are shown mounted within a door frame 14 for swinging movement towards and away from each other, each of the doors 10, 12 being provided with a crash bar 16, the crash bar in turn being interconnected with vertically extending latch bars 18 which are disposed within a swinging stile 20, the latch bars being interconnectable with either an upper portion **14*c* of the frame 14 or the threshold or sill 22 of the frame for the purpose of holding the doors when in their closed position, and permitting the doors to be opened when the crash bar 16 is depressed. Each of the doors is conventionally hinged to spaced apart portions 14*a*, 14*b* of the frame 14 by hinge means 23 interconnected to a hinge stile 21 and the frame 14, the hinge means 23** establishing a hinge line about which each of the doors swings, the hinge line being disposed at that side of each door remote from the swinging edge or stile. The doors so far described are generally conventional in the art and are known as a pair of concealed panic doors.

As previously brought out, the gap between the pair of panic doors frequently permits unauthorized entry.

Thus, a person who may desire entry into a building which has a pair of adjacent panic doors may simply insert a coat hanger or the like through the gap between the doors, engage the crash bars with the hook of the coat hanger and pull the crash bar downwardly to cause the latch bars to release the door. In accordance with the principles of this invention, means are provided to seal the gap between the two doors. In order to mount the sealing assembly of this invention, it is desirable to employ a door having a swinging stile which is provided with a generally vertically extending recess 24 which is open to the adjacent stile or an associated member, the recess being defined by a pair of spaced apart side members 26, 28 and a recessed inner member 30 having an outer surface 32 which is parallel to the edge of the door. The latch bar 18 will be disposed within a box section of the stile 20 between the recessed inner member 30 and another member 34. The stile 20 is preferably an aluminum extrusion.

Figure 2:
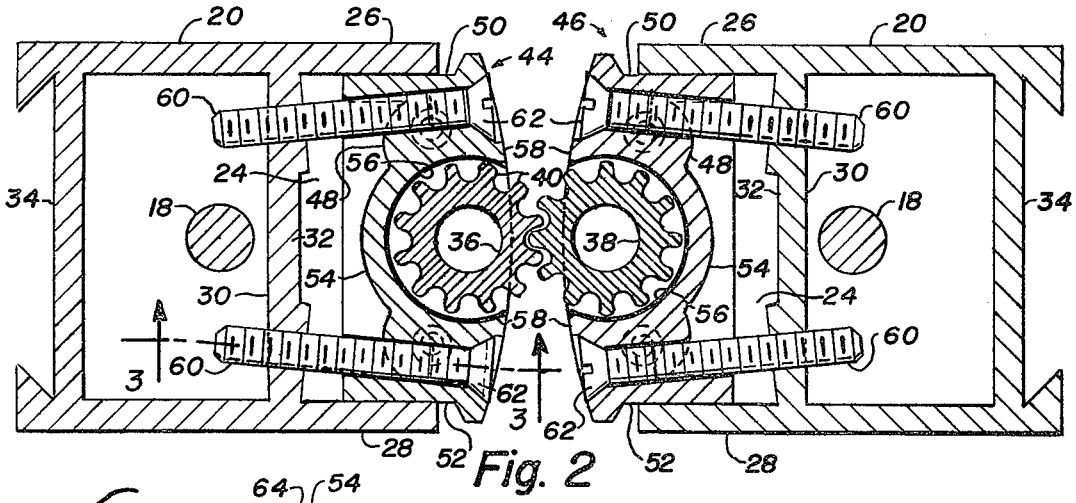
FIG. 2 is a section taken generally along the lines 2—2 in FIG. 1.

The sealing assembly which is adapted to close the gap between adjacent stiles includes (in this embodiment) first and second sealing means in the form of generally cylindrical elements 36, 38 respectively, each of the elements being substantially identical to the other one and being provided with a plurality of spaced apart teeth 40 which extend radially outwardly from the axis 42 (FIG. 3) of the associated elements. As can best be seen from FIG. 2 the first and second cylindrical elements may be gear-like in cross-section. While the elements are shown as being hollow, they may in fact be solid. The elements 36, 38 preferably extend the full length of the door.

It should be appreciated at this point that applicant's invention is not restricted solely to a pair of panic doors, but may in fact be utilized on a single door which is disposed adjacent a jamb, the invention having particular utility where the swinging stile single door can swing to either side of the jamb.

First and second mounting means, indicated generally at 44 and 46 are provided for mounting the first and second elements in such a manner that the teeth of each of the elements are parallel to the teeth of the other element and also generally parallel to the edge of the associated door. Furthermore, the first and second mounting means are so designed that the first and second element can freely rotate within the mounting means. Each of the mounting means includes a structure for mounting the associated cylindrical element for rotational movement about its axis, the structure 48 preferably being an aluminum extrusion with spaced apart walls 50, 52 which are adapted to be disposed between the side members 26, 28. While the side members are shown as part of adjacent swinging stiles, one pair of side members could be in fact part of a doorjamb. A web portion 54 extends between the spaced apart walls 50, 52, a generally cylindrical surface 56 of the web portion defining the surface of a recess or channel which is formed within each of the structures 48. Each of the channels is provided with a longitudinally extending opening which interupts cylindrical surface 56 and a curved outer surface 58 of the structure 48. The extent of the cylindrical surface 56 is sufficient to maintain the associated cylindrical element within the recess against lateral displacement. As can best be seen from FIG. 2, the teeth of the cylindrical elements project through the opening and interengage with each other when the two doors 10 and 12 are in their closed position.

The first and second mounting means 44 and 46 further include means to adjustably secure the structures 48 to the adjacent stile with the axis 42 of each of the elements 36, 38 parallel to the edge of the door. The means to adjustably secure each of the structure 48 includes fastener means 60 which may be in the form of flat head screws, the fastener means passing through a plurality of vertically spaced apart apertures within the structure 48, the apertures (no number) having a diameter slightly in excess of the maximum diameter of the screws, and the end of each of the screws remote from the head 62 of the screw passing through an associated threaded aperture within the recessed inner member 30. Stops 64 are also carried by the structure 48, the stops also being in the form of flat head screws and each of the screws 64 passing through one of a plurality of vertically spaced apart threaded apertures (no number) in the structure 48, the end of each of the screws 64 remote from the head being adapted to bear against the inner surface 32 of the recessed inner member 30. When the structure 48 is mounted within the stile 20 one end of each of the stops 64 will be biased into contact with the surface 32 by turning the fasteners 60 until the heads 62 bear against the associated seat which will in turn cause the stops 64 to be biased into contact with the surface 32. By properly adjusting the fasteners 60 and the stops 64 the cylindrical element 36 or 38 can be so adjusted with respect to the stile that the axis of the cylindrical elements are substantially parallel to the edge of the door, and also one cylindrical element can be adjusted with respect to the other that the teeth 40 are substantially parallel to each other throughout their length to effectively close the gap throughout the length of the door.

The structures 48 and the cylindrical elements 36, 38 are preferably aluminum extrusions. Furthermore, the extrusions 36, 38 may be provided with a nylon coating or the like which will reduce the friction between the various elements and also reduce noise when one element comes into contact with the other element.

Figure 3:
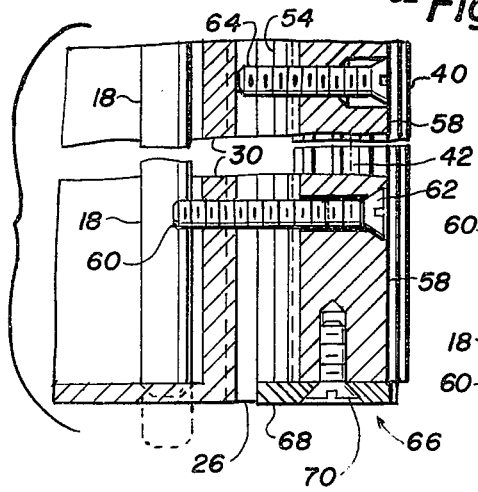
FIG. 3 is a section taken generally along the lines 3—3 in FIG. 2.

In order to prevent the cylindrical element 36, 38 from shifting vertically within the recesses within the structures 48, retaining means, indicated generally at 66, are provided at either end of each of the structure 48. The retaining means 66, which serve to retain the elements against longitudinal displacement, include a plate 68 which is secured in place by a flat headed screw 70 which is received within a tapped hole at one end of the structure 48. While a tapped hole is shown in FIG. 3 it should be appreciated that a void may be provided in the structure 48, the void being provided with a surface such that a self-tapping metal screw may engage the surface.

DESCRIPTION OF THE EMBODIMENT SHOWN IN FIG. 4

Figure 4:
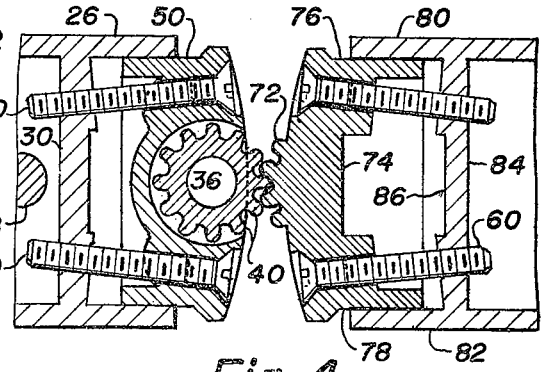
FIG. 4 is a sectional view similar to FIG. 2 showing an alternative embodiment.

In FIG. 4 a slightly differing form of an embodiment is shown. This embodiment discloses a first element and first mounting means which are substantially identical to one of the elements and mounting means shown in FIG. 2. A differing form of a second element is shown, the second element having a plurality of spaced apart outwardly extending teeth 72 which are generally in the form of the rack. The teeth are formed on an extrusion 74 which has spaced apart walls 76, 78 which are received between spaced apart side members 80, 82. The side members may be part of an adjacent stile of another door. Alternatively, the side members may be part of a doorjamb. In this regard it should also be noted that the structure of FIG. 4 could be reversed with the extrusion 74 being mounted upon a stile and the first element 36, the structure 48 and the fasteners 60 and stops (not shown) being mounted on a doorjamb. The extrusion 74 is secured to the jamb or stile with which it is associated in a manner similar to the manner in which the structure 48 is secured to its associated stile. Thus, the extrusion 74 is provided with suitable apertures through which fasteners and stops may extend, the fasteners being received within a transversely extending portion 84 and the stops abutting against an outer surface 86 of the member 84.

While the preferred embodiment in which the principles of the present invention have been incorporated have been described above, it is to be understood that the invention is not to be limited to the particular details, shown and described above, but that, in fact, widely differing means may be employed in the practice of the broader aspects of the invention.

What is claimed is:

1. A door assembly adapted to be mounted within a door frame, said door assembly comprising:

a pair of adjacent swinging doors, each door having spaced apart hinge and swinging stiles;

a pair of hinge means interconnecting said hinge stiles of said pair of doors to spaced apart portions of the frame in such a manner that each door swinges about a hinge line remote from the swinging stile with the swinging stiles of the pair of doors being disposed adjacent to each other when said pair of doors are closed;

sealing means to seal the gaps between the adjacent swinging stiles, said sealing including a pair of generally cylindrical substantially identical elements which are provided with a plurality of spaced apart teeth which extend radially outwardly from the axis of the associated element; and a pair of adjustable mounting means to mount the sealing means along the edges of the adjacent swinging stiles in such a manner that the elongated members interengage each other throughout their lengths, each of said pair of adjustable mounting means including structure for mounting an associated cylindrical element for rotational movement about its axis, and each of said adjustable mounting means further including adjustable fastener means to adjustably secure the associated structure to an associated swinging stile.

2. The door assembly set forth in claim 1 in which each of said adjacent swinging stiles is provided with a vertically extending recess open to the adjacent stile and being adapted to receive a sealing means and mounting means, the recess being defined by a pair of spaced apart side members and a recessed inner member which extends between the side members.

3. The door assembly set forth in claim 1 in which the adjustable mounting means further include stop means adjustably interconnected with said structure, the end of said stop means bearing against a surface of a portion of said associated stile, and the fasteners extending through said structure and said portion to bias one end of the stop means into contact with said portion.

4. A door assembly adapted to be mounted within a door frame, said door assembly comprising;

a pair of adjacent swinging doors, each door having spaced apart hinge and swinging stiles, each of said swinging stiles being provided with a vertically extending recess open to the adjacent stile, the recess being defined by a pair of spaced apart side members and a recessed inner member which extends between the side members;

a pair of hinge means interconnecting said hinge stiles of said pair of doors to spaced apart portions of the frame in such a manner that each door swinges about a hinge line remote from the swinging stile with the swinging stiles of the pair of doors being disposed adjacent each other when said pair of doors are closed;

sealing means to seal the gaps between the adjacent swinging stiles, said sealing means including a pair of generally cylindrical substantially identical elements which are provided with a plurality of spaced apart teeth which extend radially outwardly from the axis of the associated elements; and a pair of mounting means to mount the sealing means along the edges of the adjacent swinging stiles in such a manner that the elongated members interengage each other throughout their lengths, each of said pair of mounting means including structure for mounting an associated cylindrical element for rotational movement about its axis, said structure being received within the vertically extending recess of the associated swinging stile and said structure being provided with a channel which receives the elongated members, said channel having a cylindrical surface having an opening on one side, the extent of the cylindrical surface being sufficient to maintain the first element within the channel against lateral displacement, each of said mounting means further including fastener means to secure the associated structure to the swinging stile within said vertically extending recess, and said mounting means further including means to adjustably secure said structure to one of said adjacent stiles.

5. The door assembly set forth in claim 4 in which the means to adjustably secure said structure to one of said adjacent stiles includes stop means adjustably interconnected with said structure, one end of said stop means bearing against a surface of said recessed inner member, said fasteners extending through said structure and said inner member and being adapted to bias one end of the stop means into contact with said surface of said inner member.

6. The door assembly set forth in claim 5 further characterized by the provision of retaining means mounted at the end of the mounting means, said retaining means serving to maintain the elongated members within the channel against longitudinal displacement.

* * * * *